US010598437B2

(12) United States Patent
Niwa et al.

(10) Patent No.: US 10,598,437 B2
(45) Date of Patent: Mar. 24, 2020

(54) HYBRID METAL MELTING FURNACE

(71) Applicant: AISIN TAKAOKA CO., LTD., Toyota-shi, Aichi (JP)

(72) Inventors: Kazufumi Niwa, Toyota (JP); Hiroaki Kato, Toyota (JP); Yusuke Wakita, Toyota (JP); Yuki Kiyanagi, Toyota (JP)

(73) Assignee: AISIN TAKAOKA CO., LTD., Toyota-Shi, Aichi (JP)

( * ) Notice: Subject to any disclaimer, the term of this patent is extended or adjusted under 35 U.S.C. 154(b) by 99 days.

(21) Appl. No.: 15/763,773

(22) PCT Filed: Sep. 2, 2016

(86) PCT No.: PCT/JP2016/075837

§ 371 (c)(1),
(2) Date: Mar. 27, 2018

(87) PCT Pub. No.: WO2017/056849

PCT Pub. Date: Apr. 6, 2017

(65) Prior Publication Data

US 2018/0292134 A1 Oct. 11, 2018

(30) Foreign Application Priority Data

Sep. 28, 2015 (JP) ..... 2015-189558

(51) Int. Cl.
*F27D 1/18* (2006.01)
*F27D 11/06* (2006.01)
(Continued)

(52) U.S. Cl.
CPC ..... *F27D 1/18* (2013.01); *F27B 14/12* (2013.01); *F27B 14/14* (2013.01); *F27D 11/06* (2013.01)

(58) Field of Classification Search
CPC ..... F27B 14/12; F27B 14/14; F27D 11/06; F27D 1/18
(Continued)

(56) References Cited

U.S. PATENT DOCUMENTS 3,635,457 A 1/1972 King
5,263,690 A 11/1993 Wolters et al.
(Continued)

FOREIGN PATENT DOCUMENTS

DE 3641957 * 7/1987 ..... F27D 1/18
JP S51-71802 U 6/1976
(Continued)

OTHER PUBLICATIONS

Korean Office Action dated Jun. 19, 2018 issued by the Korean Patent Office in corresponding Korean Patent Application No. 10-2018-7011591, with English-language translation (7 pages).
(Continued)

*Primary Examiner* — Jessee R Roe
*Assistant Examiner* — Michael Aboagye
(74) *Attorney, Agent, or Firm* — Buchanan, Ingersoll & Rooney PC

(57) ABSTRACT

A hybrid metal melting furnace uses a furnace lid to hold molten metal, while inhibiting reduction in the service life of burners of the furnace lid caused by long periods of exposure to high heat. This hybrid metal melting furnace includes a crucible for accommodating metal to be melted; and an induction coil causing induced current to flow through and heat the metal. A furnace lid which closes an opening in the crucible includes: a first furnace lid having burners for injecting flames into the crucible; and a second furnace lid which does not have the burners. When melting the metal, the first furnace lid is disposed in a position in which the opening is closed. When holding the molten metal in the
(Continued)

crucible, the first furnace lid is removed from the opening, and the second furnace lid is disposed in the position in which the opening is closed.

6 Claims, 5 Drawing Sheets

(51) Int. Cl.
*F27B 14/14* (2006.01)
*F27B 14/12* (2006.01)

(58) Field of Classification Search
USPC ..... 266/160, 236, 239, 274, 275; 222/591, 222/592, 593, 595, 597
See application file for complete search history.

(56) References Cited

U.S. PATENT DOCUMENTS

| | | | | |
|---|---|---|---|---|
| 7,204,954 | B2 | 4/2007 | Mizuno et al. | |
| 7,531,127 | B2 * | 5/2009 | Mizuno ..... | B22D 35/00 266/239 |
| 2004/0070122 | A1 | 4/2004 | Mizuno et al. | |
| 2015/0063399 | A1 | 3/2015 | Geib | |

FOREIGN PATENT DOCUMENTS

| | | | | | |
|---|---|---|---|---|---|
| JP | S55-150992 | U | | 10/1980 | |
| JP | S5728672 | | * | 2/1982 | ..... F27D 1/18 |
| JP | S58-35796 | U | | 3/1983 | |
| JP | S62-62179 | A | | 3/1987 | |
| JP | H06-108172 | A | | 4/1994 | |
| JP | 2013-185719 | A | | 9/2013 | |
| WO | WO 02/051740 | A1 | | 7/2002 | |

OTHER PUBLICATIONS

International Search Report (PCT/ISA/210) dated Oct. 25, 2016, by the Japan Patent Office as the International Searching Authority for International Application No. PCT/JP2016/075837.
Written Opinion (PCT/ISA/237) dated Oct. 25, 2016, by the Japan Patent Office as the International Searching Authority for International Application No. PCT/JP2016/075837.
Office Action dated Sep. 24, 2019, by the Intellectual Property India in corresponding Indian Patent Application No. 201817015996 and an English Translation of the Office Action. (5 pages).

* cited by examiner

HYBRID METAL MELTING FURNACE

TECHNICAL FIELD

The present disclosure relates to a hybrid metal melting furnace using induction heating in combination with heating with a burner.

BACKGROUND ART

In a casting process or the like for manufacturing cast products by pouring molten metal into a casting mold, a metal melting furnace is used for melting a metal to be melted. The metal melting furnace generally employs an induction furnace system configured to pass a current to an induction coil, which is provided around a crucible for heating the metal to be melted in the crucible by generating an induction current therein. There is a known hybrid system using the induction furnace system in combination with a heating system configured to inject flames from a burner onto a metal to be melted in a crucible and melt the metal to be melted by heat of the flames (for example, see Patent Literature 1).

In the hybrid metal melting furnace of the related art, an opening of the crucible is kept opened toward the outside to allow the burner to inject flames from above the crucible. In this configuration, during a process of melting the metal to be melted, heat in the crucible dissipates through the opening, and thus probabilities of lowering of melting efficiencies and deterioration of working environment around the metal melting furnace have still been a concern even though a degree of heating is improved by employing the hybrid system.

Consequently, a configuration including a furnace lid for covering the opening of the crucible and a burner installed on the furnace lid is proposed (see Patent Literature 2). In this configuration, as the burner may inject flames toward the metal to be melted in the crucible with the opening covered with the furnace lid, heat dissipation may be restricted, and thus the above-described concern is solved.

CITATION LIST

Patent Literature

Patent Literature 1: Japanese Patent Laid-Open No. 6-108172

Patent Literature 2: Japanese Patent Laid-Open No. 2013-185719

SUMMARY OF DISCLOSURE

Technical Problem

The heat dissipation restricting function achieved in a case where the furnace lid is provided on the opening of the crucible may be used not only for melting the metal to be melted in the crucible, but also for retaining molten metal in the crucible after the metal to be melted is melted into the molten metal. In this case, by restricting dissipation of heat in the crucible, an amount of heat energy consumed for the retention of the molten metal may be reduced and a waste of the heat energy may be eliminated.

However, when the furnace lid provided with the burner is used also for the retention of the molten metal, the burner is exposed to the heat in the crucible also in a state of retaining the molten metal. As a burner is used for heating the metal to be melted, the burner is provided with heat resistance properties as a matter of course. However, when the furnace lid with the burner is used also for the retention of the molten metal, there is a concern of shortening of a service life of the burner due to long time exposure to high heat.

Accordingly, it is an object of the present disclosure to provide a hybrid metal melting furnace capable of retaining molten metal using a furnace lid while restricting shortening of a service life of a burner provided on the furnace lid due to long time exposure to high heat.

Solution to Problem

In order to achieve the above-described object, it is an object of a first disclosure to provide a hybrid metal melting furnace including: a crucible provided with an opening on an upper side and configured to retain a metal to be melted in an interior thereof; a furnace lid configured to cover the opening of the crucible; induction heating means configured to heat the metal to be melted in the crucible by passing an induction current through the metal to be melted; and a burner configured to inject flames into the crucible, characterized in that the furnace lid includes: a first furnace lid provided with the burner and a second furnace lid not provided with the burner, and the hybrid metal melting furnace further includes furnace lid moving means configured to move the first furnace lid and the second furnace lid in such a manner that the first furnace lid is placed at a position to cover the opening for melting the metal to be melted, and the first furnace lid is removed from the opening and then the second furnace lid is placed at the position to cover the opening for retaining molten metal obtained by melting the metal to be melted in the crucible.

A second disclosure according to the first disclosure is characterized in that the furnace lid moving means includes: a first supporting arm configured to support the first furnace lid, a first furnace lid drive unit configured to move the first supporting arm upward and downward to place the first furnace lid at a position to cover the opening and a position upward away from the opening, a second supporting arm disposed on a lower side of the first supporting arm, a second furnace lid drive unit configured to pivot the second supporting arm to place the second furnace lid at a position to cover the opening and a position upward away from the opening.

A third disclosure according to the second disclosure is characterized in that the hybrid metal melting furnace includes suspension support means configured to suspend and support the first furnace lid from the first supporting arm in a horizontal state, and the suspension support means includes an inclination following mechanism configured to cause the first furnace lid to incline so as to follow an inclination of the opening when the first furnace lid is placed at the opening.

A fourth disclosure according to the second disclosure or the third disclosure is characterized in that the hybrid metal melting furnace further includes a shaft having a circular shape in cross section and provided upright at a position adjacent to the opening of the crucible, and the first supporting arm is provided so as to extend sideward from the shaft, and the first furnace lid drive unit includes: a shaft moving means configured to move the shaft in a direction of an axial line thereof; and a movement guiding means configured to guide the shaft to move upward and downward while restricting a rotation of the shaft.

A fifth disclosure according to the fourth disclosure is characterized in that the hybrid metal melting furnace further includes a rotation tube in which the shaft is inserted, and the second supporting arm is provided on the rotation tube so as to extend sideward from the rotation tube, and the second furnace lid drive unit is configured to rotate the rotation tube.

A sixth disclosure according to any one of second disclosure to fifth disclosure is characterized in that the first furnace lid drive unit causes the first supporting arm to pivot and place the first furnace lid at a position upward away from the opening and at a position away from the area above the opening by a pivotal movement thereof.

A seventh disclosure according to any one of the second disclosure to the sixth disclosure is characterized in that the hybrid metal melting furnace further includes a dust collection duct having an annular shape around the opening of the crucible and including an intake port in an inner peripheral portion thereof, and the second supporting arm is provided at a height to allow the second furnace lid to cover an inner space of the dust collection duct by a pivotal movement thereof.

Advantageous Effects of the Disclosure

According to the first disclosure, for melting the metal to be melted in the crucible, the opening is covered with the first furnace lid with the burner and hence heat dissipation is restricted. In contrast, for the retention of the molten metal, the opening is covered with the second furnace lid without the burner instead of the first furnace lid. Therefore, the molten metal may be retained while heat dissipation is restricted by the second furnace lid and thus shortening of service life of the burners due to long time exposure of the burners to high heat generating in the interior of the crucible during retention of the molten metal may be restricted.

According to a second disclosure, by pivoting the second supporting arm and placing the second furnace lid at a position to cover the opening with the first supporting arm moved upward and the first furnace lid placed at a position away from the opening of the crucible, dissipation of heat from the opening during retention of the molten metal may be restricted. In this configuration, only the pivotal movement is required for the second furnace lid without necessity of the upward and downward movement of the second furnace lid and thus a simple configuration is achieved.

According to the third disclosure, since the suspension support means configured to suspend and support the first furnace lid includes the inclination following mechanism, even when the opening of the crucible is inclined, it is ensured that the opening of the crucible is covered with the furnace lid in a state of being inclined so as to follow the inclination of the opening. Accordingly, even though the opening of the crucible is inclined, formation of an excessive gap between the opening and the furnace lid, which may lead to heat dissipation therefrom, may be restricted.

According to the fourth disclosure, by the drive shaft moving in a direction of an axial line, that is, upward and downward, the first supporting arm moves upward and downward correspondingly and the position of the first furnace lid is changed between the position to cover the opening of the crucible and the position upward away from the opening.

As the shaft is formed into a circular shape in cross section, the shaft may rotate when moving upward and downward, and this rotation of the shaft may cause the first furnace lid to deviate from the area above the opening of the crucible. In this regards, in the fourth disclosure, as the movement guiding means guides the shaft upward and downward while restricting the shaft from rotating, the rotation of the shaft is restricted, thereby maintaining the first furnace lid in a state of being placed in the area above the opening. Accordingly, even when the upward and downward movement of the shaft is repeated, placement of the first furnace lid at the position to cover the opening for melting the metal is ensured.

According to the fifth disclosure, the first supporting arm configured to support the first furnace lid is provided on the shaft, and the second supporting arm configured to support the second furnace lid is provided on the rotation tube having the shaft inserted therein. Therefore, the shaft and the rotation tube are provided on the identical axial line, and thus configuration is simplified compared with the configuration in which these members have different center axes.

According to the sixth disclosure, when the molten metal in the crucible is retained with the opening covered with the second furnace lid, the first furnace lid drive unit is capable of pivoting and placing the first furnace lid at the position away from the area above the opening. With the first furnace lid placed at this position, influence of heat dissipated from the molten metal on the burners may further be reduced.

According to the seventh disclosure, the dust collection duct is provided to form the annular shape around the opening of the crucible. Therefore, gas, floating substances such as dust, metallic vapor (fume) and the like (hereinafter, referred to as "gas and the like") generating in the crucible during the process of melting the metal as well as during retention of the molten metal may be sucked and discharged out through the intake port provided on an inner peripheral portion of the dust collection duct. In the case of the dust collection apparatus employing a dust collection hood system configured to cover the opening of the crucible, a dust collection hood large enough to cover the two furnace lids, that is, the first furnace lid and the second furnace lid, and the furnace lid moving means configured to change the position of both of the furnace lids is required, which means a large scale dust collection hood is required. In this regards, as the configuration in which the dust collection duct is provided around the opening of the crucible is employed, installation of such a large scale dust collection apparatus is not necessary.

BRIEF DESCRIPTION OF DRAWINGS

FIG. 1A illustrates a state in which an upper part of a crucible is covered with a furnace lid, and FIG. 1B illustrates a state in which an upper part of the crucible is opened.

DESCRIPTION OF EMBODIMENT

Figure 1:
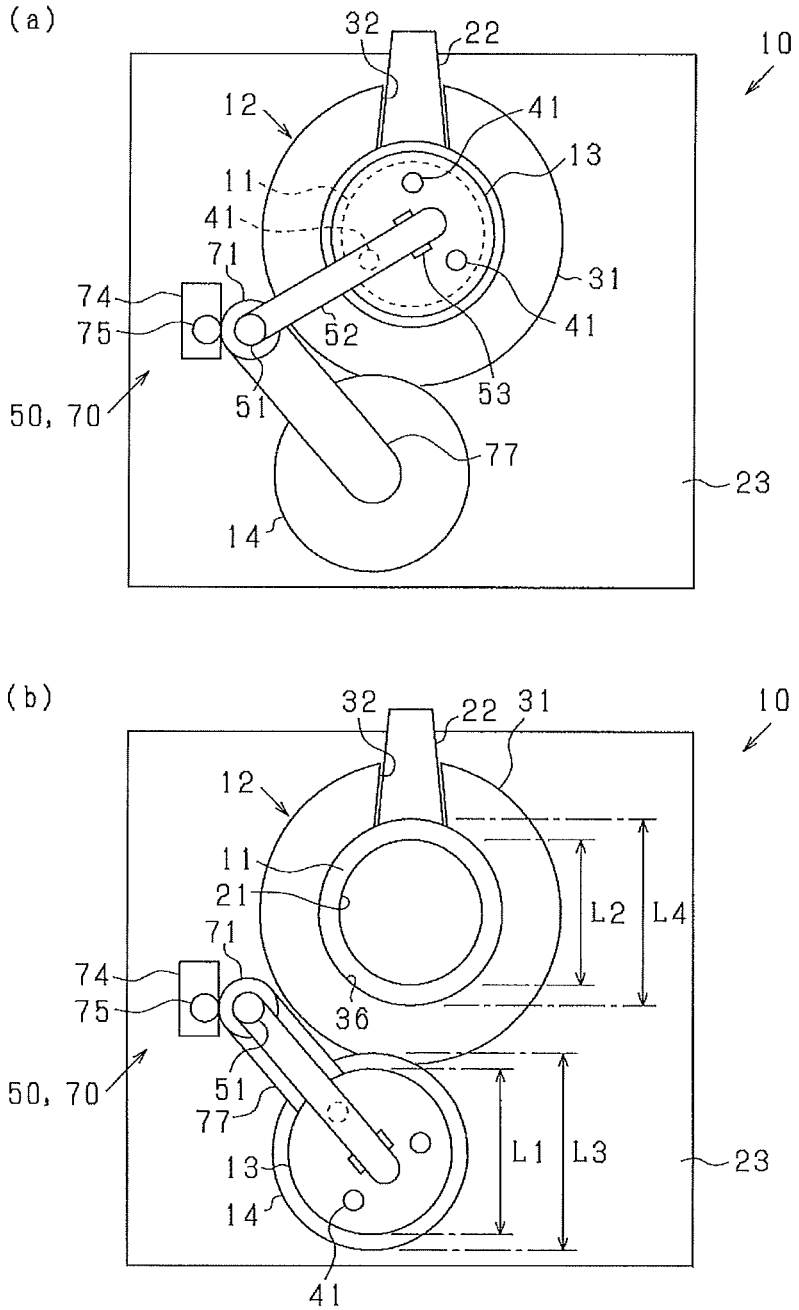
FIG. 1 is a plan view of a metal melting furnace.

Referring now to the drawings, a preferred embodiment in which the present disclosure is embodied will be described in detail. The embodiment embodies a hybrid metal melting furnace including a burner in combination with an induction furnace system.

Figure 2:
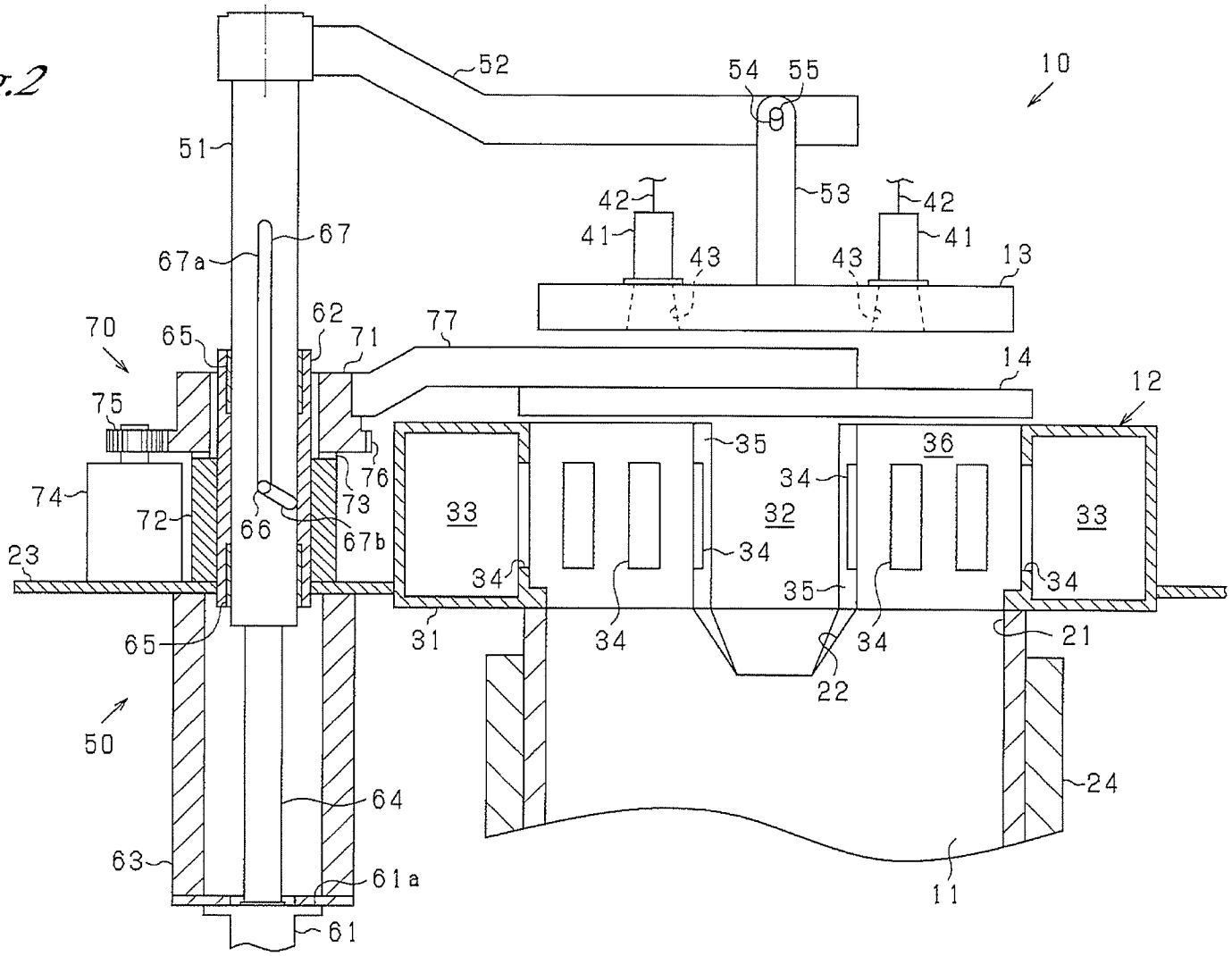
FIG. 2 is a side view, partly broken, of the metal melting furnace.

A configuration of the metal melting furnace of the embodiment will be described first. FIG. 1 is a plan view illustrating a metal melting furnace of the embodiment. FIG. 1A illustrates a state in which an upper part of a crucible is covered with a furnace lid, and FIG. 1B illustrates a state in which an upper part of the crucible is opened. FIG. 2 is a side view, partly in cross-section, illustrating a configuration of the metal melting furnace.

As illustrated in FIG. 1 and FIG. 2, a metal melting furnace 10 of the embodiment which employs a hybrid system includes a crucible 11, a dust collection apparatus 12, and two furnace lids 13, 14.

The crucible 11 is a bottomed cylindrical container. As illustrated in FIG. 1B and FIG. 2, the crucible 11 is provided with an opening 21 on an upper side thereof. A metal to be melted including casting iron and the like is loaded from the opening 21, whereby the metal to be melted is retained in the crucible 11. The crucible 11 is provided at an upper end portion thereof with a pour spout 22. As illustrated in FIG. 1, the pour spout 22 is provided so as to project sideward from the opening 21. Molten metal obtained by melting the metal to be melted in the crucible 11 is transferred from the crucible 11 to a pouring container (not illustrated) via the pour spout 22, or is poured into a casting mold.

As illustrated in FIG. 2, the crucible 11 is provided with an induction coil 24. The induction coil 24 surrounds a periphery of the cylindrical portion of the crucible 11. A magnetic field is generated in the crucible 11 by passing an AC current through the induction coil 24, and an induction current flows through the metal to be melted retained in the crucible 11 by electromagnetic induction. At this time, heat generating of the metal to be melted based on electrical resistance of itself is utilized, and thus the metal to be melted is melted by the generated heat. Therefore, the induction coil 24 corresponds to induction heating means configured to pass an induction current to the metal to be melted in the crucible 11 to heat the metal to be melted.

The dust collection apparatus 12 is an apparatus configured to collect gas generating in the crucible 11, floating substances such as dust, metallic vapor (fume) and the like (hereinafter, referred to as "gas and the like") and discharge the same to the outside during a process of melting the metal to be melted in the crucible 11. Although various types of the dust collection apparatus 12, such as that configured to cover the crucible 11 with a hood from above, are proposed, the dust collection apparatus 12 of the embodiment is a ring hood provided around the opening 21 of the crucible 11.

As illustrated in FIG. 1, the dust collection apparatus 12 includes a dust collection duct 31. The dust collection duct 31 has an annular shape, a part of which in the circumferential direction is opened to form a C-shape, and has a rectangular shape in cross section (see FIG. 2). The dust collection duct 31 surrounds the periphery of the opening 21 of the crucible 11, and is provided in a plane surface portion 23 around the crucible 11 so that an open portion 32 is placed above the pour spout 22. As illustrated in FIG. 2, an interior of the dust collection duct 31 constitutes a ventilation passage 33. The ventilation passage 33 is connected to a suction-discharge apparatus (not illustrated), and the suction-discharge apparatus (not illustrated) generates an air flow in an exhaust direction in the ventilation passage 33.

The dust collection duct 31 is provided with a plurality of intake ports 34 on an inner peripheral surface thereof along a circumferential direction. The intake ports 34 are also provided on respective end surfaces 35 that oppose to each other and define the open portion 32. Provision of the intake ports 34 allows aeration among inner space 36 of the dust collection duct 31, the open portion 32, and the ventilation passage 33. As an air flow in the exhaust direction is generated in the ventilation passage 33, an air flow is formed to flow from the inner space 36 of the dust collection duct 31 and the open portion 32 into the ventilation passage 33 through the intake ports 34. Therefore, the gas and the like generated during the process of melting the metal to be melted in the crucible 11 and reached near the opening 21 flow from the intake port 34 into the ventilation passage 33, circulate in the ventilation passage 33, and then are discharged outward.

The furnace lids 13, 14 will now be described. As illustrated in FIG. 1 and FIG. 2, the furnace lids 13, 14 are lid members each having a circular plate shape. The furnace lids 13, 14 include the first furnace lid 13 and the second furnace lid 14, and are positioned at different levels in a vertical direction. The respective furnace lids 13, 14 are configured to be changed in position respectively by a first furnace lid drive unit 50 and a second furnace lid drive unit 70. The first furnace lid drive unit 50 and the second furnace lid drive unit 70 correspond to furnace lid moving means.

FIG. 1B illustrates a state in which both of the furnace lids 13, 14 are placed at positions away from an area above the opening 21 of the crucible 11. FIG. 2 illustrates a side view in which both of the first furnace lid 13 and the second furnace lid 14 are placed in the area above the opening 21 of the crucible 11.

Figure 3:
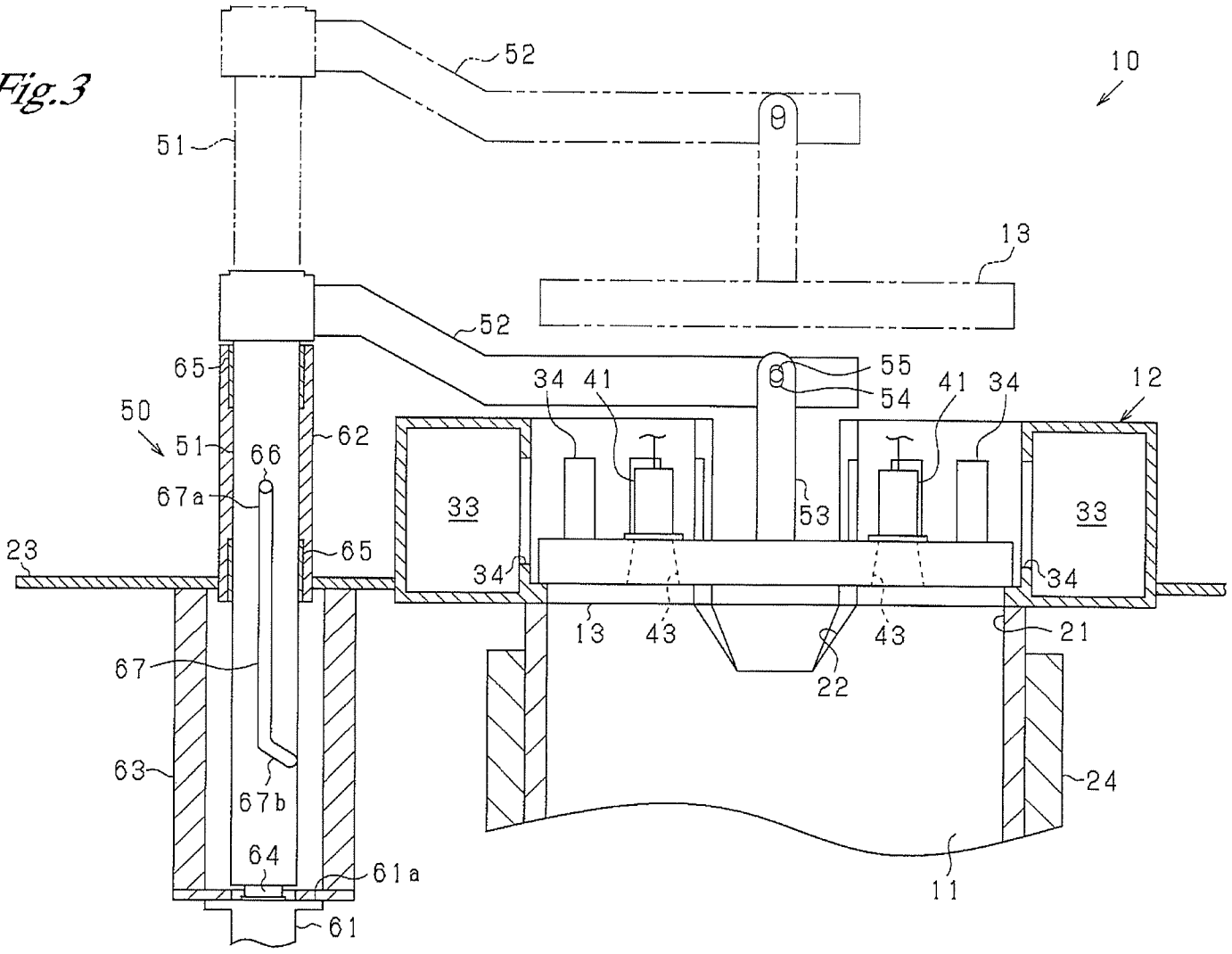
FIG. 3 is a side view, partly broken, of a first furnace lid in a state of being placed at a position to cover an opening of the crucible.

The first furnace lid 13 will be described first. The first furnace lid 13 is used as a lid member configured to cover the opening 21 while the metal to be melted supplied into the crucible 11 is heated and melted. FIG. 3 is a side view, partly broken, of the first furnace lid 13 in a state of being placed at a position to cover the opening 21 of the crucible 11. In FIG. 3, the second furnace lid 14 is omitted.

As illustrated in FIG. 1B, a diameter L1 of the first furnace lid 13 is larger than a diameter L2 of the opening 21 of the crucible 11. Therefore, as illustrated in FIG. 1A and FIG. 3, when the first furnace lid 13 is placed at a position to cover the opening 21 of the crucible 11, an entire area of the opening 21 is covered. The diameter L1 of the first furnace lid 13 does not have an enough length to cover the pour spout 22. Therefore, as illustrated in FIG. 1A and FIG. 3, even when the opening 21 is covered with the first furnace lid 13, the pour spout 22 is kept in an opened state and a communication between an interior of the crucible 11 and the outside is maintained via the pour spout 22.

Accordingly, even when the opening 21 of the crucible 11 is covered with the first furnace lid 13, a communication between an interior of the crucible 11 and the outside is maintained via the pour spout 22. The first furnace lid 13 does not seal the opening 21. Therefore, the gas and the like generating in the interior of the crucible 11 during the process of melting the metal to be melted in the crucible 11 flow out from the pour spout 22 or are leaked from the first furnace lid 13. The gas and the like are collected by the above-described dust collection apparatus 12, and are discharged outward.

The first furnace lid 13 is provided with a plurality of (three in the embodiment as illustrated in FIG. 1) burners 41. These burners 41 are arranged so as to surround a center axis of the first furnace lid 13 formed into a circular plate shape. As illustrated in FIG. 2, gas supply tubes 42 are connected to the respective burners 41, and fuel gas is supplied to the respective burners 41 through these gas supply tubes 42.

Injection holes 43 are formed in the first furnace lid 13 at positions where the burners 41 are provided, and the burners 41 inject flames from flame injection ports thereof into the crucible 11 via the injection holes 43 when the first furnace lid 13 is placed at the position to cover the opening 21 of the crucible 11. Therefore, the metal to be melted retained in the crucible 11 is heated by flames from above. With heating coupled with the induction heating of the metal to be melted described above, the metal to be melted is heated.

The first furnace lid drive unit 50 configured to change the position of the first furnace lid 13 will now be described. The first furnace lid drive unit 50 is a unit configured to drive the first furnace lid 13 to change the position. As illustrated in FIG. 1, FIG. 2, and FIG. 3, the first furnace lid drive unit 50 is provided at a position adjacent to the crucible 11 in the plane surface portion 23 around the crucible 11.

The first furnace lid drive unit 50 includes a drive shaft 51 as a shaft. The drive shaft 51 extends in a direction orthogonal to the plane surface portion 23, and is formed into a circular shape in cross section. The drive shaft 51 is provided with a first supporting arm 52 extending sideward at an upper end portion thereof. The first supporting arm 52 supports the first furnace lid 13. The first supporting arm 52 also constitutes the furnace lid moving means.

The first furnace lid 13 is provided with a coupling member 53 extending upward at a center portion (a portion of center of gravity), and the coupling member 53 is coupled to a distal end portion of the first supporting arm 52. An elongated hole 54 extending along a vertical direction is formed in the coupling member 53 at a coupled portion between the first supporting arm 52 and the coupling member 53. On the other hand, the first supporting arm 52 is provided with a mounting shaft 55 inserted into the elongated hole 54. In this manner, the first furnace lid 13 is suspended from and supported by a distal end portion of the first supporting arm 52 in a horizontal state by the mounting shaft 55 of the first supporting arm 52 provided in the elongated hole 54 of the coupling member 53.

As the mounting shaft 55 of the first supporting arm 52 is movable along the elongated hole 54, the first supporting arm 52 and the coupling member 53 are coupled in a state of having looseness at the coupled portion. In addition, the mounting shaft 55 formed into a circular shape in cross section allows the coupling member 53 and the first furnace lid 13 to incline as well. Therefore, even though the opening 21 of the crucible 11 or the peripheral edge thereof is slightly inclined, when the first furnace lid 13 comes into contact with the peripheral portion, the first furnace lid 13 also inclines so as to follow an inclination of the contact portion.

The coupling member 53, the elongated hole 54, and the mounting shaft 55 constitute suspension support means, and the elongated hole 54 and the mounting shaft portion 55 constitute an inclination following mechanism.

As illustrated in FIG. 2, the first furnace lid drive unit 50 includes a cylinder 61 as shaft moving means and an outer cylindrical member 62. A shaft accommodating tube 63 is provided under the plane surface portion 23, and is provided with a rod-side end surface 61*a* of the cylinder 61 attached thereto. The cylinder 61 is provided so that a direction of projection and retraction of a rod 64 is identical to a direction of an axial line of the drive shaft 51, and the direction of the axial line of the drive shaft 51 is identical to a direction of an axial line of the rod 64. A distal end of the rod 64 is attached to a lower end surface of the drive shaft 51, and the drive shaft 51 and the rod 64 having the identical axial line are allowed to move in the shaft accommodating tube 63 upward and downward.

The outer tube 62 is provided upright from the plane surface portion 23 so as to extend upward from an upper portion of the shaft accommodating tube 63. The center axis of the outer tube 62 is identical to center axes of the drive shaft 51 and the rod 64, and the drive shaft 51 is inserted into an inner hollow portion of the outer tube 62. Bearings 65 are provided on an inner surface of the outer tube 62 at the upper and lower end portions thereof, and the drive shaft 51 is supported by the bearings 65 so as to be movable upward and downward.

Figure 4:
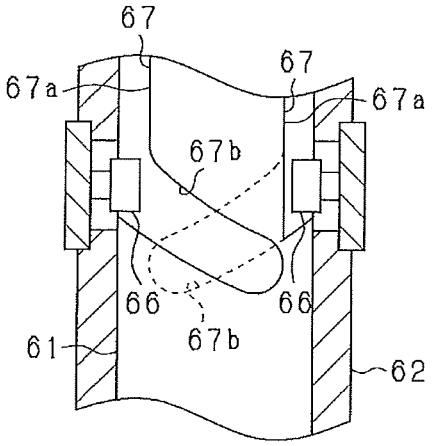
FIG. 4 is a drawing, partly in cross section, illustrating how cam followers are set.

On the inner surface of the outer tube 62 are also provided cam followers 66 projected inward. FIG. 4 is a drawing, partly in cross section, illustrating how the cam followers 66 are set. As illustrated in FIG. 4, a pair of the cam followers 66 are provided so as to oppose to each other with the drive shaft 51 interposed therebetween.

On the other hand, a pair of guide grooves 67 are formed on an outer peripheral surface of the drive shaft 51, and the cam followers 66 engage with the respective guide grooves 67. The guide grooves 67 each include a first guide groove 67*a* and a second guide groove 67*b*. The first guide grooves 67*a* are formed linearly along the direction of axial line of the drive shaft 51. The second guide grooves 67*b* are formed from lower ends of the first guide grooves 67*a* obliquely downward along the circumference direction. Therefore, the movement of the drive shaft 51 is guided along the guide grooves 67*a*, 67*b* by cam actions of the cam followers 66 and the first guide grooves 67*a* and the second guide grooves 67*b*.

As illustrated in FIG. 3, in a state in which the first furnace lid 13 is placed at a position to cover the opening 21 of the crucible 11, the cam followers 66 are placed at upper ends of the first guide grooves 67*a*. In this state, the rod 64 of the cylinder 61 is retracted and the drive shaft 51 is placed at a lower end position of a vertical movable range thereof. When the cylinder 61 is driven to expand the rod 64 from this state, the drive shaft 51 moves upward. In association with the movement of the drive shaft 51, the first supporting arm 52 and the first furnace lid 13 also move toward above the opening 21. In this state, the linear cam action of the first guide grooves 67*a* and the cam followers 66 guides the upward movement of the drive shaft 51. Accordingly, the drive shaft 51 is restricted from rotating when the drive shaft 51 moves upward. In this case, the cam followers 66 and the first guide grooves 67*a* correspond to movement guiding means.

As illustrated in FIG. 3 by chain double-dashed lines, the drive shaft member 51, the first supporting arm 52, and the first furnace lid 13 move upward until the cam followers 66 reach the lower ends of the first guide grooves 67*a*. When the rod 64 of the cylinder 61 is further expanded, the cam followers 66 enter the second guide grooves 67*b*. Accordingly, by the cam action of the second guide grooves 67*b* extending obliquely along the circumferential direction and the cam followers 66, the drive shaft 51 moves upward while rotating. Accordingly, the first supporting arm 52 and the first furnace lid 13 move upward while pivoting and are placed at a position away from the area above the opening 21 of the crucible 11 as illustrated in FIG. 1B.

The second guide grooves 67*b* are set to achieve an angle of rotation of the drive shaft 51, that is, a pivoting angle of the first supporting arm 52 and the first furnace lid 13 of 80 degrees.

When the first furnace lid 13 is placed at the position to cover the opening 21 again after the operation described above as illustrated in FIG. 3, an operation in reverse order from the order described thus far is performed. In other words, when the rod 64 of the cylinder 61 in the expanded state is retracted, the drive shaft 51 moves downward while rotating in the opposite direction by the cam action of the second guide grooves 67*b* and the cam followers 66. In association with this movement, the first supporting arm 52 and the first furnace lid 13 pivot in the opposite direction, and the first furnace lid 13 is placed in the area above the opening 21. When the rod 64 of the cylinder 61 is further retracted after that, the drive shaft 51 moves downward by the cam action of the first guide grooves 67*a* and the cam followers 66, and the first supporting arm 52 and the first furnace lid 13 moves downward correspondingly. When the cam followers 66 are placed at upper ends of the first guide grooves 67*a*, the first furnace lid 13 is placed at a position to cover the opening 21.

Figure 5:
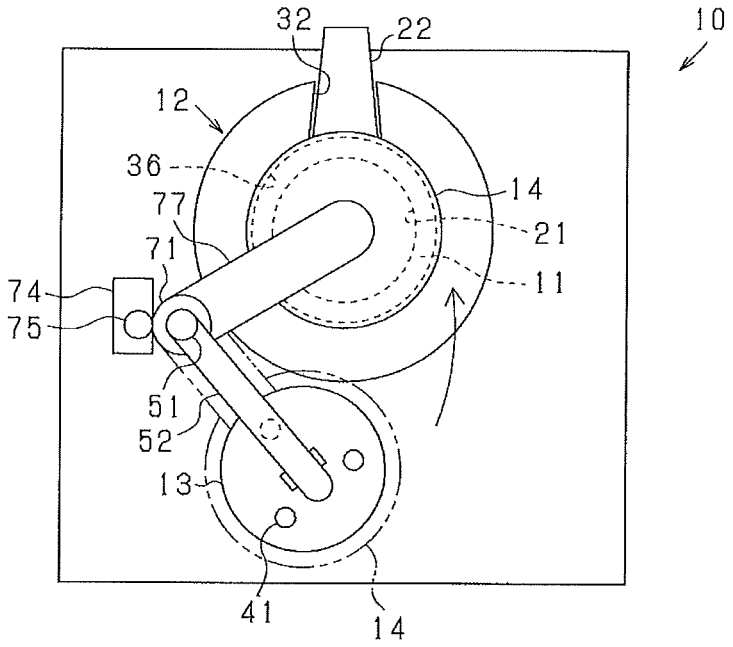
FIG. 5 is a plan view of the metal melting furnace illustrating a state of changing a position of a second furnace lid.

Referring also to FIG. 5 as well, the second furnace lid 14 will be described below. FIG. 5 is a plan view of the metal melting furnace 10, and illustrates a state of changing the position of the second furnace lid 14.

The second furnace lid 14 is used as a lid member for covering the opening 21 while molten metal obtained by melting the metal to be melted is retained. As illustrated in FIG. 1B, the second furnace lid 14 is formed so that the diameter L3 thereof is larger than the inner diameter L4 of the dust collection duct 31. Therefore, as illustrated in FIG. 2 and FIG. 5, when the second furnace lid 14 is placed on the top of the opening 21 of the crucible 11, the opening 21 is covered in plan view.

The second furnace lid 14 includes a second furnace lid drive unit 70 for driving the second furnace lid 14 and changing the position of the second furnace lid 14. As illustrated in FIG. 1 and FIG. 2, the second furnace lid drive unit 70 is provided at a position adjacent to the crucible 11 in the plane surface portion 23 around the crucible 11.

The second furnace lid drive unit 70 includes a rotation tube 71 having a cylindrical shape. The rotation tube 71 is placed on a supporting tube 72 provided on the plane surface portion 23. The rotation tube 71 and the supporting tube 72 are provided so that hollow portions thereof have an identical center axis, and the rotation tube 71 is rotatable about the center axis by a rotating member 73 interposed therebetween. The supporting tube 72 is provided on an outer peripheral side of the outer tube 62 which constitutes the first furnace lid drive unit 50, and the outer ctube 62 is inserted therethrough. Therefore, the outer tube 62 and the drive shaft 51 inserted into the outer tube 62 are inserted into the rotation tube 71 and the supporting tube 72. In this case, the center axes of the rotation tube 71 and the supporting tube 72 are identical to the center axes of the outer tube 62 and the drive shaft 51.

A rotating drive unit 74 is provided at a position adjacent to the supporting tube 72 in the plane surface portion 23. A rotating gear 75 is provided on an upper part of the rotating drive unit 74 so as to rotate about a center of rotation extending in the vertical direction, and engages with a gear portion 76 provided on an outer peripheral surface of the rotation tube 71. Therefore, when the rotating gear 75 rotates, the rotation tube 71 rotates correspondingly.

The rotation tube 71 is provided with a second supporting arm 77 extending sideward on a lower side of the first supporting arm 52. The second supporting arm 77 supports the second furnace lid 14 in a horizontal state. The second supporting arm 77 extends so that a distal end portion thereof reaches a center portion of the second furnace lid 14, and the second furnace lid 14 is attached to a lower end portion thereof. The second furnace lid 14 in a state of being supported by the second supporting arm 77 is positioned at a slightly higher level than an upper surface of the dust collection duct 31. The second supporting arm 77 also constitutes the furnace lid moving means.

As the second furnace lid drive unit 70 has such a configuration, the second furnace lid 14 is rotated (pivoted) by the rotating drive unit 74 being driven to rotate the rotating gear 75. By this pivotal movement, the second furnace lid 14 is changed in position between a position above the opening 21 of the crucible 11 as illustrated in FIG. 5 and a position away from the area above the opening 21 as illustrated in FIG. 1B. An angle of pivotal movement of the second supporting arm 77 and the second furnace lid 14 in this case is set so 80 degrees in the same manner as the first supporting arm 52 and the first furnace lid 13.

As illustrated in FIG. 2 and FIG. 5, in a state in which the second furnace lid 14 is positioned above the opening 21, the second furnace lid 14 is positioned above the inner space 36 of the dust collection duct 31. Here, as described above, the second furnace lid 14 is positioned at the slightly higher level than the upper surface of the dust collection duct 31. The second furnace lid 14 is formed so that the diameter L3 thereof is larger than the inner diameter L4 of the dust collection duct 31. Therefore, the inner space 36 is covered with the second furnace lid 14 positioned above the inner space 36 of the dust collection duct 31, whereby the top of the opening 21 of the crucible 11 is covered. Accordingly, heat in the crucible 11 is maintained and is restricted from being dissipated to the outside, and thus the molten metal in the crucible 11 may be retained.

A melting work for melting the metal to be melted and retention of the molten metal by using the metal melting furnace 10 configured as described above are performed in the following manner.

The first furnace lid drive unit 50 and the second furnace lid drive unit 70 are driven, then the first furnace lid 13 and the second furnace lid 14 are placed at positions away from above the opening 21 of the crucible 11 (waiting position). In this way, the opening 21 of the crucible 11 is opened and the metal to be melted is loaded therethrough.

The first furnace lid drive unit 50 is then driven and, as illustrated in FIG. 1A and FIG. 3, the first furnace lid 13 is pivoted from the above-described waiting position to the area above the opening 21, and is moved therefrom downward to a position to cover the opening 21. In this state, an AC current is passed through the induction coil 24 to cause induction heating of the metal to be melted and fuel gas is supplied to the burners 41 to inject flames from the burners 41 into the crucible 11 and heat the metal to be melted.

Simultaneously, the suction-discharge apparatus (not illustrated) of the dust collection apparatus 12 is driven to generate an air flow flowing from the inner space 36 of the dust collection duct 31 to the ventilation passage 33. Accordingly, the gas and the like generating during the process of melting the metal directed out from the pour spout 22 or leaked out from the first furnace lid 13 flow into the ventilation passage 33 through the intake port 34, and then are discharged therefrom.

When the work for melting the metal to be melted is terminated, the first furnace lid drive unit 50 is driven to restore the first furnace lid 13 from the position to cover the opening 21 to the waiting position, and the next work such as transfer of the molten metal to the pouring container (not illustrated) is performed.

For retention of the molten metal as-is in the crucible 11, the second furnace lid drive unit 70 is driven to cause the second furnace lid 14 to pivot horizontally and move from the waiting position to a position to cover the inner space 36 of the dust collection duct 31 as illustrated in FIG. 5. Accordingly, the opening 21 of the crucible 11 is covered, and thus heat dissipation from the crucible 11 is restricted and the molten metal is preferably retained. When the metal to be melted is supplied to the crucible 11, the second furnace lid drive unit 70 is driven to restore the second furnace lid 14 to its original waiting position.

According to the metal melting furnace 10 of the disclosure described thus far, the following effects are achieved.

For melting the metal to be melted in the crucible 11 by using the metal melting furnace 10, the opening 21 is covered with the first furnace lid 13 provided with the burners 41, and thus heat dissipation at the time of melting is restricted. For the retention of the molten metal in the crucible 11, the opening 21 is covered with the second furnace lid 14 provided with no burner 41 instead of the first furnace lid 13. Therefore, the molten metal may be retained while heat dissipation is restricted by the second furnace lid 14, and thus shortening of service life of the burners 41 due to continuous exposure of the burners 41 to high heat generating from the interior of the crucible 11 during retention of the molten metal may be restricted.

By pivoting the second supporting arm 77 and placing the second furnace lid 14 at a position to cover the opening 21 with the first furnace lid 13 placed at a position away from the opening 21 of the crucible 11, dissipation of heat from the opening 21 while the molten metal is retained may be restricted. In this configuration, as the second furnace lid 14 requires only the pivotal movement without the upward and downward movement, a simple configuration is achieved.

Looseness is provided at a coupling portion between the first supporting arm 52 and the coupling member 53 provided on the first furnace lid 13. Therefore, even when the crucible 11 is not in a horizontal state and is slightly inclined, the first furnace lid 13 inclines correspondingly to the inclination, and thus an event that a gap is formed between the opening 21 and the first furnace lid 13 and heat is dissipated therethrough is restricted.

The first furnace lid drive unit 50 configured to move the position of the first furnace lid 13 includes the drive shaft 51. By the drive shaft 51 moving in a direction of an axial line, that is, upward and downward, the first supporting arm 52 moves upward and downward, and the position of the first furnace lid 13 is changed between the position to cover the opening 21 of the crucible 11 and the position upward away from the opening 21.

As the drive shaft 51 is formed into a circular shape in cross section, the drive shaft 51 may rotate when moving upward and downward, and this rotation of the drive shaft 51 may cause the first furnace lid 13 to deviate from the area above of the opening 21 of the crucible 11. In this regards, a cam action of the first guide grooves 67*a* and the cam followers 66 guides the drive shaft 51 upward and downward while restricting the drive shaft 51 from rotating. Therefore, the rotation of the drive shaft 51 is restricted, thereby maintaining the first furnace lid 13 in a state of being placed in the area above the opening 21. Accordingly, even when the upward and downward movement of the drive shaft 51 is repeated for changing the position of the first furnace lid 13, placement of the first furnace lid 13 at the position to cover the opening 21 is ensured.

The first furnace lid 13 is pivoted by the first furnace lid drive unit 50 and is placed at the position upward away from the opening 21 of the crucible 11 and is pivoted therefrom and is placed at the position away from the area above the opening 21. Therefore, when the molten metal in the crucible 11 is retained with the opening 21 covered with the second furnace lid 14, the first furnace lid 13 is pivoted and thus the first furnace lid 13 is placed at the position away from the area above the opening 21. With the first furnace lid 13 placed at this position, influence of heat dissipated from the molten metal in the crucible 11 on the burners 41 may further be reduced.

In the first furnace lid drive unit 50, the first supporting arm 52 configured to support the first furnace lid 13 is provided on the drive shaft 51, and the second supporting arm 77 configured to support the second furnace lid 14 is provided on the rotation tube 71 into which the drive shaft 51 is inserted. Therefore, the drive shaft 51 and the rotation tube 71 are provided on the identical center axis, and thus configuration is simplified compared with the configuration in which these members are provided to have different center axes.

The dust collection duct 31 having the C-shape opened partly in the circumferential direction is provided around the opening 21 of the crucible 11 as the dust collection apparatus 12. The gas and the like generating in the crucible during the process of melting the metal as well as during retention of the molten metal may be sucked and discharged out through the intake port 34 provided on an inner peripheral portion of the dust collection duct 31. Assuming that the dust collection apparatus employs a dust collection hood system configured to cover the opening 21 of the crucible 11, a large scale dust collection hood enough to cover the first furnace lid 13 and the second furnace lid 14 as well as the first furnace lid drive unit 50 and the second furnace lid drive unit 70 is required. In this regards, as the ring hood provided with the dust collection duct 31 around the opening 21 of the crucible 11 is employed, installation of such a large scale dust collection apparatus is not necessary.

Implementation of the present disclosure is not limited to the embodiment described thus far, and the following implementation, for example, is also applicable.

(1) The embodiment described above employs a configuration in which the drive shaft 51 and the outer cylindrical member 62 are inserted into the rotation tube 71 configured to pivot the second supporting arm 77, and the center axes of these members are identical. Instead of this configuration, the rotation tube 71 may be installed at a position separate from the drive shaft 51 as a rotation shaft, and two supporting members may be provided for supporting the first supporting arm 52 and the second supporting arm 77 respectively.

(2) Although the dust collection apparatus 12 is provided in the embodiment described above, the dust collection apparatus 12 may be omitted. In this case, a height of the second furnace lid 14 is set to be positioned at the opening 21 of the crucible 11. However, it is preferable to employ the configuration including the dust collection apparatus 12 for discharging the gas and the like generating during the process of melting the metal as well as during retention of the molten metal.

Even in the case where the dust collection apparatus 12 is installed, instead of the ring hood as in the embodiment described above, a configuration including the opening 21 of the crucible 11, the two furnace lids 13, 14, the first furnace lid drive unit 50 and the second furnace lid drive unit 70, and a dust collection hood configured to cover these members entirely from above may also be employed.

(3) Although the first furnace lid drive unit 50 is configured to cause the first supporting arm 52 and the first furnace lid 13 not only to move upward and downward, but also to make a pivotal movement in the embodiment described above, a configuration in which the pivotal movement is omitted may also be employed. In this configuration as well, the influence of the heat from the molten metal on the burners 41 may be restricted by moving the first furnace lid 13 upward to a position upward away from the opening 21.

(4) Although the second furnace lid drive unit 70 is configured to only make the second supporting arm 77 and the second furnace lid 14 pivot in the embodiment described above, a configuration in which the second supporting arm 77 and the second furnace lid 14 move upward and downward in addition to the pivotal movement may also be employed. In this configuration, by moving the second furnace lid 14 placed above the opening 21 of the crucible 11 toward the opening 21, formation of a gap along a peripheral edge of the second furnace lid 14, which may lead to dissipation of heat therefrom, may be restricted.

(5) Although the configuration in which the first furnace lid 13 is suspended and supported at the distal end of the first supporting arm 52 is employed in the embodiment described above, a configuration in which the first furnace lid 13 is mounted on the first supporting arm 52 like the second furnace lid 14 mounted on the second supporting arm 77 may also be employed.

(6) In the embodiment described above, looseness is provided by the elongated hole 54 and the mounting shaft 55 at the coupling portion between the first supporting arm 52 and the coupling member 53 provided on the first furnace lid 13. The configuration in which the looseness is provided may be omitted. However, the configuration including the looseness is preferable for causing the first furnace lid 13 to follow the inclination of the crucible 11 and restricting the formation of the gap.

(7) Although the cylinder 61 is employed as the shaft moving means in the embodiment described above, a configuration in which the drive shaft 51 is configured to move upward and downward by using a mechanical element such as a rack-and-pinion is also applicable.

REFERENCE SIGN LIST

10 . . . hybrid metal melting furnace, 11 . . . crucible, 13 . . . first furnace lid, 14 . . . second furnace lid, 21 . . . opening, 23 . . . induction coil (induction heating means), 31 . . . dust collection duct, 34 . . . intake port, 41 . . . burners, 50 . . . first furnace lid drive unit (furnace lid moving means), 51 . . . drive shaft (shaft), 52 . . . first supporting arm (furnace lid moving means), 53 . . . coupling member (suspension support means), 54 . . . elongated hole (suspension support means, inclination following mechanism), 55 . . . mounting shaft (suspension support means, inclination following mechanism), 61 . . . cylinder (shaft moving means), 66 . . . cam followers (movement guiding means), 67*a* . . . first guide grooves (movement guiding means), 70 . . . second furnace lid drive unit (furnace lid moving means), 71 . . . rotation tube, 77 . . . second supporting arm (furnace lid moving means).

The invention claimed is:

1. A hybrid metal melting furnace comprising:

a crucible provided with an opening on an upper side and configured to retain a metal to be melted in an interior thereof;

induction heating means configured to heat the metal to be melted in the crucible by passing an induction current through the metal to be melted;

a first furnace lid configured to cover the opening of the crucible and provided with a burner configured to inject flames into the crucible;

a second furnace lid not provided with a burner and configured to cover the opening in the crucible;

a first supporting arm configured to support the first furnace lid;

a first furnace lid drive unit configured to move the first supporting arm upward and downward to place the first furnace lid at a position to cover the opening and a position upward away from the opening;

a second supporting arm disposed on a lower side of the first supporting arm, and a second furnace lid drive unit configured to pivot the second supporting arm to place the second furnace lid at a position to cover the opening and a position away from the opening when the first furnace lid is placed at the position upward away from the opening by the first furnace drive unit and a position away from the opening when the first furnace lid is placed at the position to cover the opening by the first furnace lid drive unit.

2. The hybrid metal melting furnace according to claim 1, further comprising:

suspension support means configured to suspend and support the first furnace lid from the first supporting arm in a horizontal state, wherein the suspension support means comprises an inclination following mechanism configured to cause the first furnace lid to incline so as to follow an inclination of the opening when the first furnace lid is placed at the opening.

3. The hybrid metal melting furnace according to claim 1, further comprising:

a shaft having a circular shape in cross section and provided upright at a position adjacent to the opening of the crucible, wherein the first supporting arm is provided so as to extend sideward from the shaft, and the first furnace lid drive unit includes:

shaft moving means configured to move the shaft in a direction of an axial line thereof; and movement guiding means configured to guide the shaft to move upward and downward while restricting a rotation of the shaft.

4. The hybrid metal melting furnace according to claim 3, further comprising:

a rotation tube in which the shaft is inserted, wherein the second supporting arm is provided on the rotation tube so as to extend sideward from the rotation tube, and the second furnace lid drive unit is configured to rotate the rotation tube.

5. The hybrid metal melting furnace according to claim 1, wherein the first furnace lid drive unit causes the first supporting arm to pivot and place the first furnace lid at a position upward away from the opening and at a position away from the area above the opening by a pivotal movement thereof.

6. The hybrid metal melting furnace according to claim 1, further comprising:

a dust collection duct having an annular shape around the opening of the crucible and including an intake port in an inner peripheral portion thereof, wherein the second supporting arm is provided at height to allow the second furnace lid to cover an inner space of the dust collection duct by a pivotal movement thereof.

* * * * *